252-147 AU 166 EX
7/13/82 XR 4,339,282

United States Patent [19]
Lada et al.
[11] 4,339,282
[45] Jul. 13, 1982

[54] METHOD AND COMPOSITION FOR REMOVING ALUMINIDE COATINGS FROM NICKEL SUPERALLOYS

[75] Inventors: Henry Lada, Lake Park; Robert E. Fishter, Boca Raton, both of Fla.

[73] Assignee: United Technologies Corporation, Hartford, Conn.

[21] Appl. No.: 270,179

[22] Filed: Jun. 3, 1981

[51] Int. Cl.[3] ..... C23G 1/04; C23G 1/10

[52] U.S. Cl. ..... 134/3; 134/28; 134/41; 156/665; 252/79.2; 252/147

[58] Field of Search ..... 134/3, 28, 37, 41; 252/79.2, 147; 156/665

[56] References Cited

U.S. PATENT DOCUMENTS 2,684,892 7/1954 Saulnier ..... 252/79.2 X
3,467,599 9/1969 Pugliarissi ..... 134/41 X
3,856,694 12/1974 Becking ..... 134/41 X
3,859,149 1/1975 Kay ..... 252/79.2 X
4,032,359 6/1977 Fisher et al. ..... 134/3
4,089,736 5/1978 Fisher et al. ..... 134/41 X
4,274,908 6/1981 Fishter et al. ..... 252/79.2 X

*Primary Examiner*—Marc L. Caroff
*Attorney, Agent, or Firm*—C. G. Nessler

[57] ABSTRACT

Nickel aluminide and like coatings are stripped from nickel base superalloy substrates using a 60°-71° C. solution consisting essentially by volume percent of 43–48 nitric acid, 7–12 hydrochloric acid, balance water, and containing 0.008–0.025 mole/liter ferric chloride and at least 0.016 mole/liter copper sulfate. Coating removal is rapid while significant attack of the substrate is avoided.

5 Claims, No Drawings

METHOD AND COMPOSITION FOR REMOVING ALUMINIDE COATINGS FROM NICKEL SUPERALLOYS

The Government has rights in this invention pursuant to Contract F33657-79-C-0002 awarded by the Department of the Air Force.

BACKGROUND ART

The present invention is related to chemical etchants and processes for removing coatings from metal parts, particularly to the removal of corrosion resisting coatings from nickel superalloys.

High temperature superalloys, such as the alloys U-700, IN-100, MAR M-200 and the like, designed for use at high temperatures in gas turbine engines, are especially strong and resistant to oxidation and corrosion at high temperatures. However, the design of superalloy compositions always involves trade-offs between improved corrosion resistance and improved strength. For this reason, superalloy components often are surfaced with coatings of materials specially formulated to resist corrosion.

During use, parts become worn or damaged to the point where they must be restored using various processes, such as machining, shaping, and welding. In these processes it is often necessary to subject the part to a high temperature, or expose it to a repeat of the original heat treatment, during which the coating would undesirably interact with the substrate. Because of this, and because the old coating may be uneven and itself deteriorated, it is necessary to remove, or strip, the old coating from the part. Because of the irregular contours of parts such as gas turbine blades, this often cannot be conveniently done by mechanical means. Furthermore, mechanical abrasion has the disadvantage of inevitably removing some of the substrate which parts having critical dimensions cannot withstand. Consequently, chemical stripping methods are preferred. Typically, a part is immersed in a chemical solution which attacks the coating. However, stripping is not easily done because the very nature of the coating is that it is resistant to chemical attack in general. Furthermore, a chemical solution sufficiently strong to attack the coating in an economically feasible time also tends to attack the substrate material, which is particularly disadvantageous if it results in localized attack at the grain boundaries. The substrate is thereby weakened, and restoration of the part to service becomes impossible.

The present invention is particularly addressed to the problem of removing an aluminide coating from nickel base superalloy. Typical composition of such a coating would be that obtained by a pack cementation process using aluminum silicon alloy powder, such as referred to in U.S. Pat. No. 3,544,348 to Boone et al. Basically, the coating on the finished part is nickel aluminide, NiAl. Various chemical solutions have been used heretofore for stripping aluminide coatings from nickel superalloys. In the practice, the component is repetitively immersed in an acid solution, rinsed in water, dried, grit blasted and re-immersed in the acid, etc. Solutions which have been used are, by volume, 20% nitric acid, balance water; 12.5% nitric acid, 5% phosphoric acid, balance water; 15 gm/liter water of proprietary Metex M628 dry acid salts (Mac Dermid Corp., Waterbury, Connecticut); and a mixture of nitric acid, water and proprietary solution ASC-2-N (Alloy Surfaces, Inc., Wilmington, Delaware). With the most favored 20% nitric acid solution, during each immersion vigorous agitation is required to prevent local pitting. This means that any areas of a component, such as recesses or cavities which cannot be easily flushed, are potentially prone to localized pitting which may degrade the mechanical strength of the component. Coating removal is slow, but the total immersion time in the acid solution must not exceed 7 hours, since it has been determined that beyond this time the substrate will be adversely attacked intergranularly.

Thus, there is a need for an improved method for removing aluminide coatings which the present invention fulfills. The invention is related to copending application Ser. No. 192,668, "Selective Chemical Milling of Recast Surfaces," filed Oct. 1, 1980 by the same inventors hereof; described therein is selective chemical milling of recast layers resulting from localized melting of superalloys, such as those based on MAR M-200 alloy. A somewhat lesser degree of relationship will be found with application Ser. No. 192,667, "Chemical Milling of High Tungsten Content Superalloys," filed Oct. 1, 1980 by the common inventors hereof, together with Manty; disclosed are solutions for chemical milling superalloys having high tungsten contents.

DISCLOSURE OF THE INVENTION

According to the invention, aluminide coatings are removed from nickel base alloys by contacting the coating with a stripping solution having the composition by volume percent 43–48 concentrated nitric acid, 7–12 concentrated hydrochloric acid, balance water, containing 0.008–0.025 mole/liter $FeCl_3$, and at least 0.016 mole/liter $CuSO_4$. Preferably, the solution contains by volume percent 45 nitric acid, 9–11 hydrochloric acid, balance water, at least 0.008 mole/liter $FeCl_3$, and $CuSO_4$ maintained in a molar ratio of 2:1 with the ferric chloride. During stripping, a component is preferably immersed in an agitated solution at 60°–71° C. and subjected to periodic vapor blasting.

The invention is effective in rapidly moving aluminum alloy coatings from nickel alloy substrates. Yet, there is no significant attack of the substrate, even if it is left in the solution for a substantial period after all the coating is removed. Therefore stripping is eased and speeded, and restoration costs are lowered.

BEST MODE FOR CARRYING OUT THE INVENTION

The best mode of the invention is described in terms of stripping a coating nominally of NiAl from the superalloy MAR M-200+Hf (by weight percent 9 Cr, 10 Co, 2 Ti, 5 Al, 12.5 W, 0.14 C, 1 Cb, 2 Hf, 0.015 B, bal. Ni). However, the invention will be generally found useful to remove other composition aluminum containing coatings from other nickel base superalloys such as B-1900, IN-100, U-700, etc.

In the invention a preferred stripping solution consists by volume percent of 45 $HNO_3$, 11 HCl, balance $H_2O$, to which is added 0.008 mole/liter $FeCl_3$ and 0.016 mole/liter $CuSO_4$. As used herein $HNO_3$ refers to concentrated nitric acid (70%) and HCl refers to concentrated hydrochloric acid (37%). A number of stripping solutions were evaluated in arriving at the preferred invention, some of which are shown in Table 1. The manner in which the solutions were evaluated was to determine the rate of coating removal, together with the degree of substrate metal attack, on specimens of MAR M-200+Hf having an 88 Al-12 Si-halide type pack cementation coating about 0.04–0.08 mm thick. Whether a coating has been removed can be determined by heating a component in an oxidizing atmosphere at about 540° C. for about an hour; a blue color indicates unprotected base metal and removal of the coating; gray indicates coating remains. To determine if base metal attack resulted, the specimen was examined metallographically using conventional nickel alloy etchants. Observations were made to the surface for pitting and the degree to which grain boundaries were attacked. The solutions were vigorously agitated while at 60°–71° C. Periodically, the specimens were removed from the solutions, rinsed and water vapor blasted using minus $74\times10^{-6}$m silica particulate at the intervals indicated in the Table. The data show that when hydrochloric acid was not present, the removal of the coating was unacceptably slow. See tests 9 and 11. On the other hand, when the concentration of hydrochloric acid was raised to 13% or higher, substrate attack was observed. See tests 4 and 5. The inclusion of ferric chloride and copper sulfate in combination was found necessary. Their total absence caused base metal attack within 4 minutes, as in test 6. If only the copper sulfate was present, there was also attack, as test 7 indicates. Thus, the use of only ferric chloride enhances the rate of removal of the coating, but also tends to cause pitting and intergranular attack; these tendencies are inhibited by the addition of the copper sulfate which, however, as a sole addition is deleterious. Previously, we disclosed similar effects in the copending application Ser. No. 192,668 while removing recast layers.

As the result of the foregoing studies it was concluded that an improved solution will have nitric acid between 43–48%, preferably 45%; hydrochloric acid, which as pointed out must be carefully controlled, should not exceed 12% and may range down to 7% or even below, if low rates of removal are desired. But, preferably, the amount of hydrochloric acid is pushed towards the high end of our range, that is, around 9–11%, to achieve a good stripping rate while practically avoiding problems that may arise due to variations in solutions with time, and in metal compositions from component to component. Based on our prior experiment and the results here, ferric chloride can range between 0.008–0.025 mole/liter; at least 0.016 mole/liter copper sulfate should be presented. Our related experience has shown that the amount of copper sulfate may range up to 0.083 mole/liter. The molar ratio of copper sulfate ferric chloride is preferred to be in the ratio of about 2 to 1.

TABLE 1

EFFECTS OF SOLUTION COMPOSITION ON COATING AND SUBSTRATE

| Test | Percent by Volume | | | g/m liter | | Immersion | Coating | Substrate |
|---|---|---|---|---|---|---|---|---|
| Number | $HNO_3$ | HCl | $H_2O$ | $FeCl_3$ | $CuSO_4$ | time | Removal rate | attack |
| 1 | 48 | 5 | 47 | 1.3 | 2.6 | a | good | Nil |
| 2 | 45 | 9 | 46 | " | " | a | " | " |
| 3 | 45 | 11 | 44 | " | " | c | " | " |
| 4 | 43 | 13 | 44 | " | " | c | " | slight |
| 5 | 42 | 17 | 41 | " | " | c | " | significant |
| 6 | 45 | 9 | 46 | — | — | a | " | significant |
| 7 | 45 | 9 | 46 | — | 2.6 | a | " | slight |
| 8 | 45 | 9 | 46 | 1.3 | — | a | " | Nil |
| 9 | 50 | — | 50 | 1.3 | 2.6 | a | slow | " |
| 10 | 45 | 9 | 46 | 2.6 | 2.6 | a | good | " |
| 11 | 50 | — | 50 | — | — | b | slow | " |
| 12 | 45 | 9 | 46 | 13.2 | 2.6 | b | good | significant |

a 4 min. total; vapor blast after each 1 min.
b 10 min. total; vapor blast after each 5 min.
c 20 min. total; vapor blast after each 10 min.

The preferred sequence of operations when using the new solution is as follows: vapor blast; immerse in the solution for 10 minutes; remove and rinse; vapor blast; immerse in the solution for 10 minutes; remove and rinse; vapor blast; verify coating removal. Thus, it may be seen that it is possible to remove an approximate 0.05 mm thick aluminide coating in about 20 minutes, compared to a time of about 180 minutes using the techniques of the prior art described in the background section. In addition, because of its unique chemistry, the new solution does not attack the base metal, should the part be immersed additional time. In our tests 1 and 2 the substrate was immersed for 30 additional minutes and suffered no deleterious attack.

Periodic vapor blasting is very important to enhancing the use of the new solution. The coating tends to be attacked from around the edges of the test piece first. Vapor blasting tends to even out this reaction and cause the removal of the coating from the middle of the test piece. The effects of periodic vapor blasting were evaluated, from blasting every minute, to every five minutes, to every ten minutes, to not at all. It is, of course, desirable from a labor utilization standpoint to minimize the number of vapor blasting treatments. However, without vapor blasting a smut builds up which slows the removal rate greatly. With the optimum solution, in test 3 it was found that one vapor blast treatment after 10 minutes would suffice; if the coating were not entirely removed after an additional 10 minutes immersion, then another blasting would have been used. A final vapor blasting is given at the end to remove residual smut and improve appearance. Agitation is desired according to conventional practice, to avoid stagnation and local depletion of the solution. The temperature range may vary from that indicated above. However, at lower temperatures removal rate is slow; at high temperatures there is greater volitalization of the solution and resultant change in composition.

While the invention is described in terms of removing a nickel aluminide coating from MAR M-200, it is believed that the invention will be useful for removing other coatings which are predominantly aluminum, including those approximating $Ni_3Al$, $Ni_2Al$, etc. In fact, any other coating which is susceptible to the solution attack may be removed, since the merit of our solution is that it attacks certain materials, but in the time required to remove a typical coating, it will not significantly attack unprotected adjacent nickel alloy substrate material.

Although this invention has been shown and described with respect to a preferred embodiment, it will be understood by those skilled in the art that various changes in form and detail thereof may be made without departing from the spirit and scope of the claimed invention.

We claim:

1. The process of removing an aluminide coating from a nickel superalloy article characterized by contacting the coating with a stripping solution having a composition consisting essentially by volume percent of 43–48 concentrated nitric acid, 7–12 concentrated hydrochloric acid, 40–50 water, at least 0.016 mole/liter $CuSO_4$ and 0.008–0.025 mole/liter ferric chloride.

2. The process of claim 1 wherein the composition is more particularly characterized as 43–48 concentrated nitric acid and 9–11 concentrated hydrochloric acid, 41–48 water, and wherein the molar ratio of $FeCl_3$ and $CuSO_4$ is maintained at about 1:2.

3. The process of claims 1 or 2 wherein the solution is maintained at about 60°–71° C. and wherein the article is removed from contact with the solution and vapor blasted at periodic intervals.

4. A stripping solution for removing an aluminide coating from a nickel base superalloy consisting essentially by volume percent of 43–48 concentrated nitric acid, 7–12 concentrated hydrochloric acid, 40–50 water, at least 0.016 mole/liter$CuSO_4$ and 0.008–0.025 mole/liter ferric chloride.

5. The stripping solution of claim 4 more particularly characterized as 43–48 concentrated nitric acid, 9–11 concentrated hydrochloric acid, 41–48 water, and wherein the molar ratio of $FeCl_3$ and $CuSO_4$ is maintained at about 1:2.

* * * * *